United States Patent [19]

Tudisco

[11] 3,935,762

[45] Feb. 3, 1976

[54] TOOL ASSEMBLY FOR MOUNTING BITS

[75] Inventor: Vincent J. Tudisco, Emerson, N.J.

[73] Assignee: Creative Tools, Inc., Bennington, Vt.

[22] Filed: Nov. 12, 1974

[21] Appl. No.: 523,168

[52] U.S. Cl. ..... 81/177 G; 145/50 R; 279/102

[51] Int. Cl.[2] ..... B25B 15/00

[58] Field of Search..... 81/177 A, 177 G; 145/50 R, 145/50 A, 50 C, 61 C; 279/79, 102

[56] References Cited

UNITED STATES PATENTS

| | | | |
|---|---|---|---|
| 1,721,065 | 7/1929 | Boomer | 279/102 |
| 2,483,563 | 10/1949 | Rock | 279/79 X |
| 2,596,594 | 5/1952 | Petre | 279/79 |
| 2,605,110 | 7/1952 | Blum | 279/102 X |
| 2,806,706 | 9/1957 | Fitch | 145/50 R X |
| 3,375,860 | 4/1968 | Vosbikian et al. | 279/102 X |
| 3,742,787 | 7/1973 | Whiteford | 145/61 C X |

FOREIGN PATENTS OR APPLICATIONS

| | | | |
|---|---|---|---|
| 2,445,383 | 5/1955 | France | 145/50 A |

*Primary Examiner*—Al Lawrence Smith
*Assistant Examiner*—James G. Smith

[57] ABSTRACT

A tool assembly for mounting bits includes a tubular shank with an enlarged end portion in which is seated a tool bit receiving socket and its other end inserted into a handle. The socket has a cavity opening at the outer end in which is seated the body portion of tool bits. Releasable retaining means in the cavity retains the inserted tool bits which seat against a shoulder therewithin. The socket itself has a peripheral collar seated against the end of the shank and seats internally against a shoulder within the cavity of the shank provided by the enlarged end portion.

7 Claims, 7 Drawing Figures

TOOL ASSEMBLY FOR MOUNTING BITS

BACKGROUND OF THE INVENTION

Various tool assemblies have been designed to provide means for interchanging tool bits, the principal advantage being that one handle assembly can be used with bits of different sizes and functions, thus reducing the number of complete tools that must be purchased and maintained. A further advantage is that when the bit wears out or is damaged it can simply be replaced instead of having to replace the entire tool assembly.

However, these tool assemblies tend to be somewhat heavy and expensive in that they utilize solid shanks to support bit receiving sockets or shanks formed integrally with the sockets. In another type of tool assembly, the tool bit is integrally formed with an elongated shank seating in a socket within the handle; thus a larger and more expensive part must be interchanged or replaced. In those tool assemblies comprised of integrally formed handle/shank portions, need for a different-sized shank or damage to either element requires replacement of the entire assembly.

It is an object of this invention to provide a novel tool assembly for mounting interchangeable bits that may be simply, readily, and inexpensively fabricated.

It is also an object of this invention to provide such a tool assembly with a shank and bit receiving socket assembly which is both lightweight and strong.

Another object is to provide such a tool assembly permitting use of lightweight but strong drawn tubular stock for the shank and simple deformation techniques.

SUMMARY OF THE INVENTION

It has now been found that the foregoing and related objects of the invention are readily attained in a tool assembly comprising a tubular shank having a cavity extending therethrough with one end portion of greater width than the adjacent body portion. An internal peripheral shoulder is provided at the juncture of the enlarged end portion and adjacent body portion, the shoulder generally facing the open end of the enlarged end portion.

The body portion of a tool bit receiving socket is seated within the enlarged end portion of the shank, and the outer end of the socket has an external collar that seats against the open end of the shank while the inner end of the socket abuts the internal shoulder of the shank. The socket has a cavity opening outwardly to receive the body portion of inserted tool bits, releasable retaining means to retain the tool bits in the socket cavity, and an outwardly facing shoulder against which the inserted tool bit is seated to limit its inward movement. The work engaging portion of the tool bit extends outwardly from the socket cavity.

In the preferred embodiment, the other end portion of the tubular shank has a polygonal cross section and seats snugly within a cavity of cooperating cross section in a handle member. The socket cavity has a generally polygonal cross section that cooperates with the polygonal cross section of the body portion of the tool bit to seat it snugly therewithin, and the shoulder in the socket cavity is the bottom wall defining the cavity.

In its preferred aspect, the releasable retaining means comprises a periphereal groove in the socket cavity and a resilient split ring that seats in the groove and also seats in a cooperating peripheral groove in the body portion of the inserted tool bit.

The body portion of the tubular shank, its enlarged end portion, and the tool bit receiving socket preferably have generally circular cross sections. The socket has a plurality of axially extending ribs on its outer surface that interengage with the wall of the enlarged end portion of the shank to limit relative rotational movement.

DETAILED DESCRIPTION OF THE ILLUSTRATED EMBODIMENT

Figure 1:
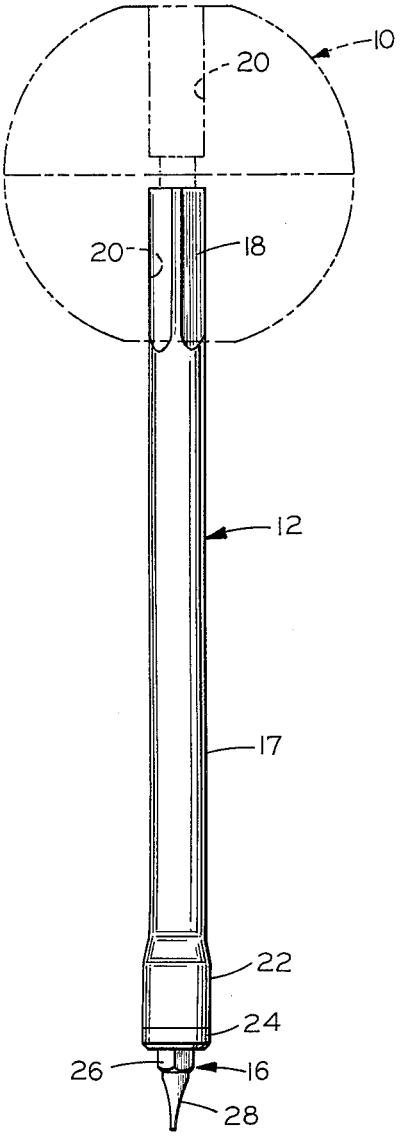
FIG. 1 is an elevational view of a tool assembly embodying the present invention with the handle shown in phantom line for clarity of illustration.

Turning now to the attached drawing in detail, it can be seen that the tool assembly of the present invention is comprised of a handle member generally designated by the numeral 10, a tubular shank generally designated by the numeral 12, a tool bit receiving socket generally designated by the numeral 14, and a tool bit generally designated by the numeral 16. The handle 10 is generally spherical with diametrically opposed cavities 20 of square cross section to seat one end of the shank 12.

Figure 2:
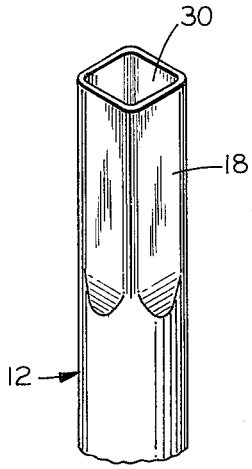
FIG. 2 is a fragmentary perspective view of the handle end of the tool shank to a scale enlarged from that of FIG. 1.
Figure 3:
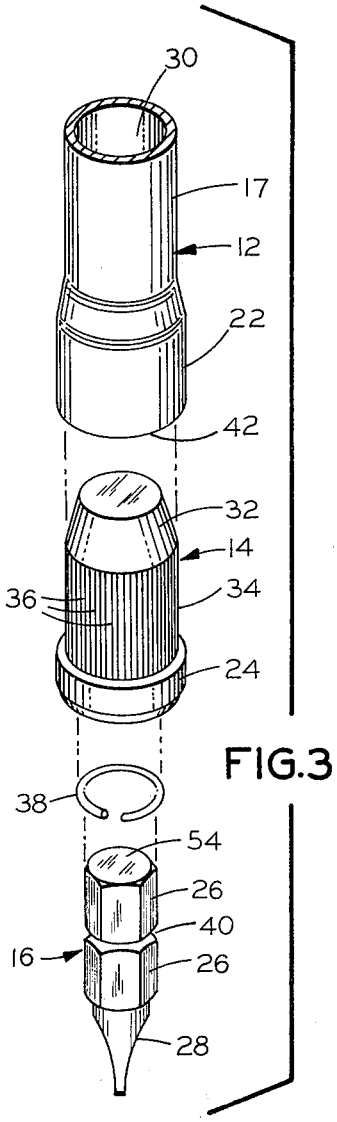
FIG. 3 is a fragmentary exploded perspective view of the tool shank, socket and bit assembly to the same scale as FIG. 2.
Figure 6:
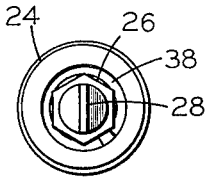
FIG. 6 is a bottom view of the tool shank and tool bit in assembly.
Figure 7:
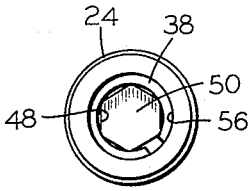
FIG. 7 is a bottom view similar to FIG. 6 with the tool bit removed.

As best seen in FIGS. 2 and 3, the tubular shank 12 has a cavity 30 extending therethrough and its one end portion 18 is of generally square cross section so as to seat snugly in the handle cavity 20. The other or outer end portion 22 is expanded to a greater width than the adjacent body portion 17 to provide a generally outwardly facing shoulder 46 at the inner end of the socket receiving cavity provided thereby. Both the body portion 17 and the enlarged outer end portion 22 are of generally circular cross section so that the shank 12 is conveniently formed from cylindrical tubing stock.

Figure 5:
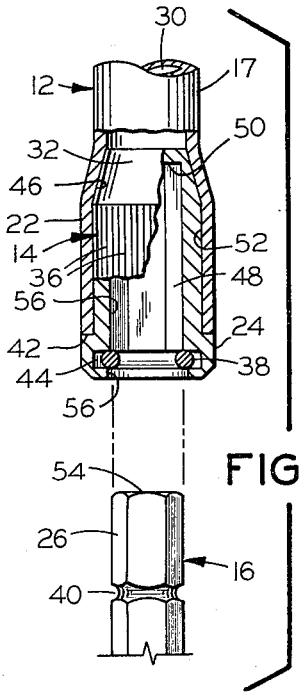
FIG. 5 is a fragmentary partially exploded cross sectional view of the tool shank assembly with the shank and socket broken away in part to reveal internal construction.
Figure 4:
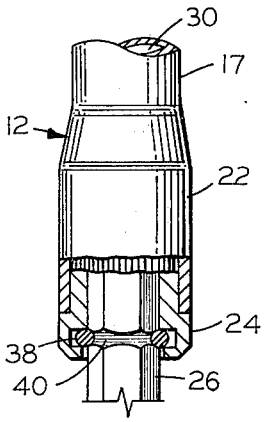
FIG. 4 is a fragmentary side elevational view of the assembled tool shank, socket and bit subassembly with a portion of the shank and socket broken away to reveal internal construction.

As best seen in FIGS. 3–5, the tool bit receiving socket 14 is of generally circular cross section and has a body portion 34 seated in the enlarged cavity of the end portion 22 of the tubular shank 12. To provide firm support against axial movement inwardly of the cavity 30, a circumferential collar 24 adjacent the outer end of the socket 14 seats against the shank end wall 42, and the inwardly tapered inner end 32 of the socket 14 seats against the internal shoulder 46 of the shank 12, as best seen in FIG. 5. Thus the socket 14 is supported against longitudinal forces by the abutment of two pairs of surfaces. To prevent relative rotation, the socket 14 is provided with a multiplicity of axially extending ribs 36 on the outer surface of the body portion 34 which bite into the surface of the inner wall 52 of the shank end portion 22 when the socket 14 is driven thereinto.

The socket 14 has an outwardly opening cavity 48 of generally hexagonal cross section in which is seated the cooperatively configured body portion 26 of the tool bit 16, which has its inner end 54 abutting the bottom wall 50 of the socket cavity 48. The work engaging portion 28 of the tool bit 16 extends outwardly of the socket cavity 48, and this will vary in configuration and dimensioning depending upon the tool bit selected for seating therein. Thus the cooperating hexagonal cross sections of the socket cavity 48 and the body portion 26 of the tool bit 16 prevent the bit 16 from rotating with respect to the socket 14, and the abutment of the inner end 54 of the tool bit 16 with the cavity wall 50 limits the displacement longitudinally into the socket 14.

To retain the bit 16 against inadvertent disassembly, the socket 14 is provided with releasable tool bit retaining means comprising a peripheral groove 44 adjacent the outer end of the wall 56 defining the cavity 48. A resilient split ring 38 is seated in the groove 44 and in a peripheral groove 40 of the tool bit 16 to provide a snap engagement upon insertion of the tool bit 16 into the socket cavity 48. This prevents the bit 16 from being inadvertently discharged from the socket cavity 48 although the ring 38 may be spread readily when desired to draw the bit outwardly by applying sufficient force to cam the ends of the ring apart.

It can be seen that the tool is readily fabricated by forming a length of tubular stock of cylindrical configuration to provide the polygonal cross section at one end and expanding the other end to provide the enlarged end portion. The socket is conveniently cast into the desired configuration and machined to provide the split ring seating recess although it may be machined in its entirety. The socket is driven into the enlarged end portion of the shank to seat the collar firmly against the end of the shank and the tapered shoulder at the inner end against the shoulder formed at the juncture of the enlarged end portion with the body portion. Either before or after assembly of the socket with the shank, the split ring can be inserted into the groove within the bit receiving cavity. Lastly, the shank is assembled within the handle. The bits can be inserted and removed as desired.

Although the preferred cross section for the enlarged end portion of the shank and socket is circular because of ease of fabrication and assembly, a polygonal or other curvilinear configuration may be employed if so desired and this could minimize the need for axial ribs to prevent relative rotation. The socket may be secured within the shank by additional means including adhesives and tack welding, and the tubing can be rolled about the body portion of the socket to increase interengagement if so desired.

Various means for releasably retaining the tool bits within the socket can be employed including resilient O-rings, compressible sleeves, and magnets to provide the desired degree of retention within the cavity.

Thus, it can be seen from the foregoing specification and drawing that the tool assembly of the present invention is lightweight yet strong, and highly effective to seat interchangeable tool bits. The assembly may be simply, readily and inexpensively fabricated and permits use of tubular stock for the shank element.

Having thus described the invention, I claim:

1. A tool assembly for releasably retaining interchangeable tool bits comprising a handle member having a cavity of polygonal cross section, a tubular shank having a cavity extending therethrough with one end portion having a polygonal cross section complementary with said cross section of said handle member cavity and snugly seated therewithin, the other end portion of said shank of greater width than the adjacent body portion to provide an enlarged end portion defining an internal peripheral shoulder at the juncture thereof generally facing the open end of said enlarged end portion; a tool bit receiving socket having a body portion seated in the cavity of said other end portion of said shank and having an external collar at its outer end seated against said open end of said shank, said socket having its inner end abutting said internal shoulder of said shank, said socket having a tool bit receiving cavity opening at its outer end and releasable tool bit retaining means and an outwardly facing shoulder in said cavity both spaced inwardly from the open end thereof; and a tool bit having a body portion seated in said socket cavity and a work engaging portion outwardly thereof, said body portion abutting said socket shoulder to limit movement inwardly of said socket cavity, said releasable retaining means releasably engaging said body portion of said tool bit to retain it within said cavity.

2. The tool assembly of claim 1 wherein said tool bit receiving cavity has a generally polygonal cross section and wherein said body portion of said seated tool bit has a cooperating polygonal cross section and seats snugly therewithin.

3. The tool assembly of claim 1 wherein said outwardly facing shoulder of said tool bit receiving cavity is the bottom wall defining said cavity.

4. The tool assembly of claim 1 wherein said tool bit has a peripheral groove in said body portion thereof and wherein said retaining means comprises a resilient split ring seating in said groove of said tool bit and a cooperating groove in the tool bit receiving cavity.

5. The tool assembly of claim 1 wherein said body portion of said tubular shank, said enlarged end portion thereof, and said tool bit receiving socket are all of generally circular cross section.

6. The tool assembly of claim 5 wherein said body portion of said socket has a plurality of axially extending ribs on the outer surface thereof interengaged with the wall of said shank defining said enlarged end portion.

7. The tool assembly of claim 1 wherein said body portion of said tubular shank, said enlarged end portion thereof, and said tool bit receiving socket are all of generally circular cross section and wherein said body portion of said socket has a plurality of axially extending ribs on the outer surface thereof interengaged with the wall of said shank defining said enlarged end portion thereof; wherein said tool bit receiving cavity has a generally polygonal cross section and said body portion of said seated tool bit has a cooperating polygonal cross section and seats snugly therewithin; and wherein said outwardly facing shoulder of said tool bit receiving cavity is the bottom wall defining said cavity.

* * * * *